US008371911B2

(12) United States Patent
Tsubota

(10) Patent No.: US 8,371,911 B2
(45) Date of Patent: Feb. 12, 2013

(54) COIN TRANSPORTING DEVICE AND COIN HANDLING MACHINE

(75) Inventor: Yugen Tsubota, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 249 days.

(21) Appl. No.: 12/735,552

(22) PCT Filed: Jan. 28, 2008

(86) PCT No.: PCT/JP2008/051157

§ 371 (c)(1),
(2), (4) Date: Jul. 26, 2010

(87) PCT Pub. No.: WO2009/095980

PCT Pub. Date: Aug. 6, 2009

(65) Prior Publication Data

US 2010/0311315 A1 Dec. 9, 2010

(51) Int. Cl.
*G07D 1/00* (2006.01)

(52) U.S. Cl. ..... 453/57; 194/200

(58) Field of Classification Search ..... 453/18, 453/29, 30, 33, 34, 35, 49, 57; 194/200, 194/217, 342, 344, 345; 235/379; 902/17, 902/41

See application file for complete search history.

(56) References Cited

U.S. PATENT DOCUMENTS

| | | | | |
|---|---|---|---|---|
| 4,356,829 | A | * | 11/1982 | Furuya ..... 453/32 |
| 4,360,034 | A | * | 11/1982 | Davila et al. ..... 453/8 |

FOREIGN PATENT DOCUMENTS

| | | | |
|---|---|---|---|
| EP | 0 345 868 | | 5/1989 |
| EP | 1 843 302 | A1 | 10/2007 |
| JP | 07-234953 | | 9/1995 |
| JP | 09-007030 | | 1/1997 |
| JP | 09-035109 | | 2/1997 |
| JP | 2000-090316 | | 3/2000 |
| JP | 2002-367013 | | 12/2002 |
| JP | 2004-110632 | | 4/2004 |
| JP | 2006-236118 | | 9/2006 |
| WO | WO 98/08198 | | 2/1998 |
| WO | WO 2007/034699 | A1 | 3/2007 |

OTHER PUBLICATIONS

European Supplementary Search Report (dated Feb. 3, 2011—7 pages).

* cited by examiner

*Primary Examiner* — Mark Beauchaine
(74) *Attorney, Agent, or Firm* — Renner, Kenner, Greive, Bobak, Taylor & Weber

(57) ABSTRACT

A coin handling machine 11 is provided in which when coins jam in a transport path 67 during coin transportation, coins jamming in the transport path 67 are automatically taken out and the state can be restored.

Coins pooled in a feeding portion 31 are fed one by one to the transport path 67, and the coins in the transport path 67 are pushed and transported one by one by projections of the deposit transporting belt 70 of the transport path 67. When coins jam in the transport path 67 during coin transportation, driving of the feeding portion 31 is stopped, the discharge gate of the feeding portion 31 is opened, and the deposit transporting belt 70 is rotated in a direction opposite to a transporting direction. Coins jamming in the transport path 67 are returned to the feeding portion 31 by the deposit transporting belt 70, discharged downward from the discharge gate 62 of the feeding portion 31, and returned to a tray 20 of a dispensing outlet 19. The state can be restored by automatically taking out coins jamming in the transport path 67.

11 Claims, 10 Drawing Sheets

COIN TRANSPORTING DEVICE AND COIN HANDLING MACHINE

TECHNICAL FIELD

The present invention relates to a coin transporting device and a coin handling machine.

BACKGROUND ART

Conventionally, in various coin handling machines which handle coins, such as ticket vending machines which issue tickets and food tickets, etc., automatic vending machines which sell goods, ATMs (Automatic Teller Machines) and CDs (Cash Dispensers) which perform money depositing and dispensing processes, and operator machines, etc., a coin transporting device which transports coins by holding coins between a pair of belts is frequently used.

A coin transporting device which automatically takes jamming coins out for restore if a coin jam occurs when the coins are transported by using such a coin transporting device, is known (for example, refer to Patent Document 1).

In this coin transporting device, a serial transport path is formed by a first transport path which transports coins upward by holding the coins between a pair of belts and a second transport path which transports coins to be placed on the belt upper surface to an entrance of the first transport path. A roller is disposed above the second transport path and guides are disposed on both side surfaces of the roller, and the guides prevent coins from entering between one belt and the roller which form the first transport path. When coins jam between the roller and the second transport path, the jamming coins can be taken out by reversing the transport path.

Patent document 1: Japanese Laid-Open Patent Publication No. 2002-367013 (page 1, FIGS. 1 to 2)

DISCLOSURE OF THE INVENTION

Problem to be Solved by the Invention

However, in the conventional coin transporting device, coins are transported by being held between a pair of belts, so that in many cases dust and foreign material adhering to the coins are also held by the belts and accumulated in the transport path, and transporting failures are often caused by this dust and foreign material, etc.

Transportation of coins held between a pair of belts utilizes friction between the belts and coins, and according to changes in the friction coefficient due to the degrees of contamination and material adhering to the coins, and further, according to changes in the friction coefficient of the belts due to ambient temperature changes and changes with age, the gripping force for holding the coins changes and the coin transporting state becomes unstable, and transporting processes such as accurate coin recognition and sorting become impossible.

The present invention has been made in view of these circumstances, and an object thereof is to provide a coin transporting device and a coin handling machine which prevent coin transporting failures from being caused by dust and foreign material, etc., prevent the conventional unstable coin transporting state from being caused by fluctuation in the friction coefficient between coins and the transporting belts, and can stabilize the coin transporting state, and realize excellent operability and convenience which enable restore in case of coin jam in the transport path during coin transportation by automatically taking the jamming coins out from the transport path.

Means to Solve the Problems

A coin transporting device according to the present invention which transports coins, includes: a feeding unit which pools coins not aligned and feeds the pooled coins one by one; a transport path which receives coins fed from the feeding unit; a transporting body including a plurality of projections which receive coins fed into the transport path from the feeding unit and enables the coins to be pushed and transported one by one in the transport path; a transporting body driving unit which drives the transporting body; a discharge gate which is provided in the feeding unit and allows coins to be pooled in the feeding unit in a gate closed state, and allows the coins inside the feeding unit to be discharged to the outside in a gate opened state; a discharge gate driving unit which drives the discharge gate; a coin takeout unit formed so as to receive coins discharged from the discharge gate and allow the received coins to be taken out from the outside of the device; and a control unit which feeds coins into the transport path by driving the feeding unit when transporting the coins, transports coins inside the transport path by the transporting body by driving the transporting body driving unit, and when coins jam in the transport path during coin transportation, stops driving of the feeding unit, opens the discharge gate by driving the discharge gate driving unit, returns the coins jamming in the transport path to the feeding unit by the transporting body by driving the transporting body driving unit in a direction opposite to a transporting direction, and discharges the coins to the coin takeout unit via the discharge gate.

In the coin transporting device of the present invention, the feeding unit includes: a coin gateway which coins can enter and exit from; a rotary disk which is attached to a rotation axis and is rotated at a position inclined at a predetermined angle with respect to the horizontal direction; a hopper which pools coins on the surface side of the rotary disk; a picking-up member which projects from the surface of the rotary disk and picks the pooled coins up one by one; and a delivering disk which is disposed near the coin gateway, receives coins picked up one by one at predetermined intervals by the picking-up member, and delivers the coins one by one to the transporting body.

In the coin transporting device of the present invention, the discharge gate forms a part of the lower side of the hopper.

In the coin transporting device of the present invention, the control unit drives the transporting body driving unit in a direction opposite to the transporting direction at a speed slower than driving in the transporting direction when discharging coins jamming in the transport path to the coin takeout unit.

A coin handling machine of the present invention which handles coins includes: a feeding unit which pools coins not aligned and feeds the pooled coins one by one; a transport path which receives coins fed from the feeding unit; a transporting body including a plurality of projections which receive coins fed into the transport path from the feeding unit and enables the coins to be pushed and transported one by one inside the transport path; a transporting body driving unit which drives the transporting body; a discharge gate which is provided in the feeding unit and allows coins to be pooled in the feeding unit in a gate closed state, and allows the coins inside the feeding unit to be discharged to the outside in a gate opened state; a discharge gate driving unit which drives the discharge gate; a coin dispensing unit formed so as to receive coins discharged from the discharge gate and allow the received coins to be taken out from the outside of the coin handling machine; and a control unit which feeds coins into the transport path by driving the feeding unit when transporting the coins, transports coins in the transport path by the transporting body by driving the transporting body driving unit, and when coins jam in the transport path during coin transportation, stops driving of the feeding unit, opens the discharge gate by driving the discharge gate driving unit, returns the coins jamming in the transport path to the feeding unit by the transporting body by driving the transporting body driving unit in a direction opposite to a transporting direction, and discharges the coins to the coin dispensing unit via the discharge gate.

In the coin handling machine of the present invention, the feeding unit includes: a coin gateway which coins can enter and exit from; a rotary disk which is attached to a rotation axis and is rotated at a position inclined at a predetermined angle with respect to the horizontal direction; a hopper which pools coins on the surface side of the rotary disk; a picking-up member which projects from the surface of the rotary disk and picks the pooled coins up one by one; and a delivering disk which is disposed near the coin gateway, receives coins picked up one by one at predetermined intervals by the picking-up member, and delivers the coins one by one to the transporting body.

In the coin handling machine of the present invention, the discharge gate forms a part of the lower side of the hopper.

A coin handling machine of the present invention includes: a communication unit capable of communicating with an external apparatus, and after coins jam during coin transportation, the control unit opens the discharge gate by driving the discharge gate driving unit according to a restore command issued from the external apparatus via the communication unit, returns the coins jamming in the transport path to the feeding unit by the transporting body by driving the transporting body driving unit in a direction opposite to the transporting direction, and discharges the coins to the coin dispensing unit via the discharge gate.

A coin handling machine of the present invention includes: a coin storing unit which stores coins and allows stored coins to be dispensed to the coin dispensing unit according to a dispensing command issued from the external apparatus via the communication unit, and the coin dispensing unit is formed so as to receive the coins dispensed from the coin storing unit and allow the received coins to be taken out from the outside of the coin handling machine.

A coin handling machine of the present invention includes: a setting unit which sets whether restore will be performed upon waiting for a restore command from the external apparatus or restore will be performed without waiting for a restore command from the external apparatus after coins jam during coin transportation, and when restore without waiting for a restore command from the external apparatus is set by the setting means, the control unit discharges coins jamming in the transport path to the coin dispensing unit without waiting for a restore command from the external apparatus via the communication unit after the coins jam during coin transportation.

In the coin handling machine of the present invention, the control unit drives the transporting body driving unit in a direction opposite to the transporting direction at a speed slower than driving in the transporting direction when discharging coins jamming in the transport path to the coin dispensing unit.

In the coin transporting device of the present invention, coins in the transport path are pushed and transported one by one by the projections of the transporting body, so that coin transporting failures can be prevented from being caused by dust and foreign material, and conventional unstableness of the coin transporting state caused by fluctuations in the friction coefficient between the coins and transporting belt does not occur and the coin transporting state can be stabilized, and further, when coins jam during coin transportation, driving of the feeding unit is stopped, and the discharge gate is opened by driving the discharge gate driving unit, coins jamming in the transport path are returned to the feeding unit by the transporting body by driving the transporting body driving unit in a direction opposite to the transporting direction, and the coins are discharged to the coin takeout unit via the discharge gate, so that the coins jamming in the transport path can be automatically taken out and the state can be restored, so that a coin transporting device with excellent operability and convenience can be provided.

In addition to the advantages of the coin transporting device of the present invention, coins pooled between a rotary disk inclined at a predetermined angle with respect to the horizontal direction and a hopper are picked up one by one by the picking-up member of the rotary disk and delivered one by one to the transporting body by the delivering disk, so that dust and foreign material, etc., can be prevented from being fed into the transport path, and coin transporting failures can be prevented from being caused by dust and foreign material.

In addition to the advantages of the coin transporting device of the present invention, by opening the discharge gate forming a part of the lower side of the hopper, coins can be reliably discharged from a portion between the rotary disk and the hopper.

In addition to the advantages of the coin transporting device of the present invention, when coins jamming in the transport path are discharged to the coin takeout unit, the transporting body driving unit is driven in a direction opposite to the transporting direction at a speed slower than driving in the transporting direction, so that even if the jamming coins are stuck, such a stuck state can be reliably eliminated.

In the coin handling machine of the present invention, coins in the transport path are pushed and transported one by one by the projections of the transporting body, so that coin transporting failures can be prevented from being caused by dust and foreign material, etc., and conventional unstableness of the coin transporting state caused by fluctuations in the friction coefficient between the coins and transporting belt does not occur and the coin transporting state can be stabilized, and further, when coins jam during coin transportation, driving of the feeding unit is stopped, the discharge gate is opened by driving the discharge gate driving unit, and coins jamming in the transport path are returned to the feeding unit by the transporting body by driving the transporting body driving unit in a direction opposite to the transporting direction, and the coins are discharged to the coin dispensing unit via the discharge gate, so that the coins jamming in the transport path can be automatically taken out and the state can be restored, so that a coin transporting device with excellent operability and convenience can be provided.

In addition to the advantages of the coin handling machine of the present invention, coins pooled between the rotary disk inclined at a predetermined angle with respect to the horizontal direction and the hopper are picked up one by one by the picking-up member of the rotary disk and delivered one by one to the transporting body by the small-diameter delivering disk, so that dust and foreign material, etc., can be prevented from being fed into the transport path, and coin transporting failures can be prevented from being caused by dust and foreign material, etc.

In addition to the advantages of the coin handling machine of the present invention, by opening the discharge gate forming a part of the lower side of the hopper, coins can be reliably discharged from the portion between the rotary disk and the hopper.

In addition to the advantages of the coin handling machine of the present invention, when the machine is capable of communicating with an external apparatus, after coins jam during coin transportation, according to a restore command issued from external apparatus via the communication unit, coins jamming in the transport path can be discharged to the coin dispensing unit.

In addition to the advantages of the coin handling machine of the present invention, the coin dispensing unit which discharges coins jamming in the transport path is commonly used as a coin dispensing unit which pays out coins to be dispensed from the coin storing unit according to a dispensing command issued from the external apparatus, so that the usability is improved.

In addition to the advantages of the coin handling machine of the present invention, the setting means allows it to be arbitrarily selected whether restore will be performed upon waiting for a restore command from the external apparatus or restore will be performed without waiting for a restore command from the external apparatus, after coins jam during coin transportation.

In addition to the advantages of the coin handling machine of the present invention, when coins jamming in the transport path are discharged to the coin dispensing unit, the transporting body driving unit is driven in a direction opposite to the transporting direction at a speed slower than driving in the transporting direction, so that even if the jamming coins are stuck, the stuck state can be reliably eliminated.

REFERENCE NUMERALS

Figure 1:
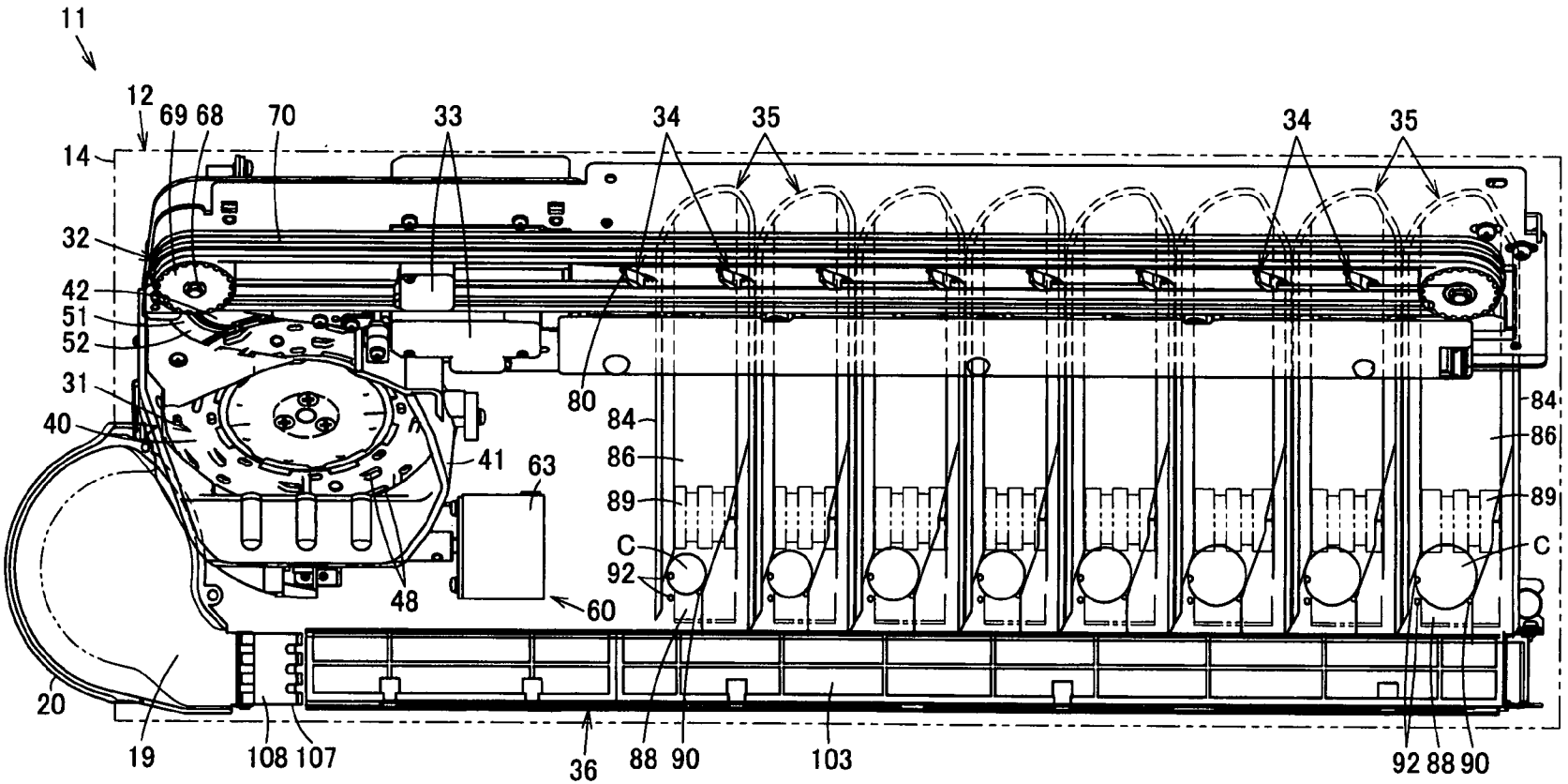
FIG. 1 is a plan view showing an internal structure of a coin handling machine according to a first embodiment of the present invention.

11 Coin handling machine
20 Tray as coin takeout unit and coin dispensing unit
31 Feeding portion as feeding unit
35 Coin storing unit
39 Rotation axis
40 Rotary disk
41 Hopper
42 Small-diameter disk
48 Picking-up member
50 Coin gateway
62 Discharge gate
63 Discharge gate drive motor as discharge gate driving unit
67 Transport path
70 Deposit transporting belt as transporting body
71 Deposit transporting belt drive motor as transporting body driving unit
72 Projection
121 Control unit
123 Setting unit
124 Communication unit

BEST MODE FOR CARRYING OUT THE INVENTION

Hereinafter, an embodiment of the present invention will be described with reference to the drawings.

Figure 9:
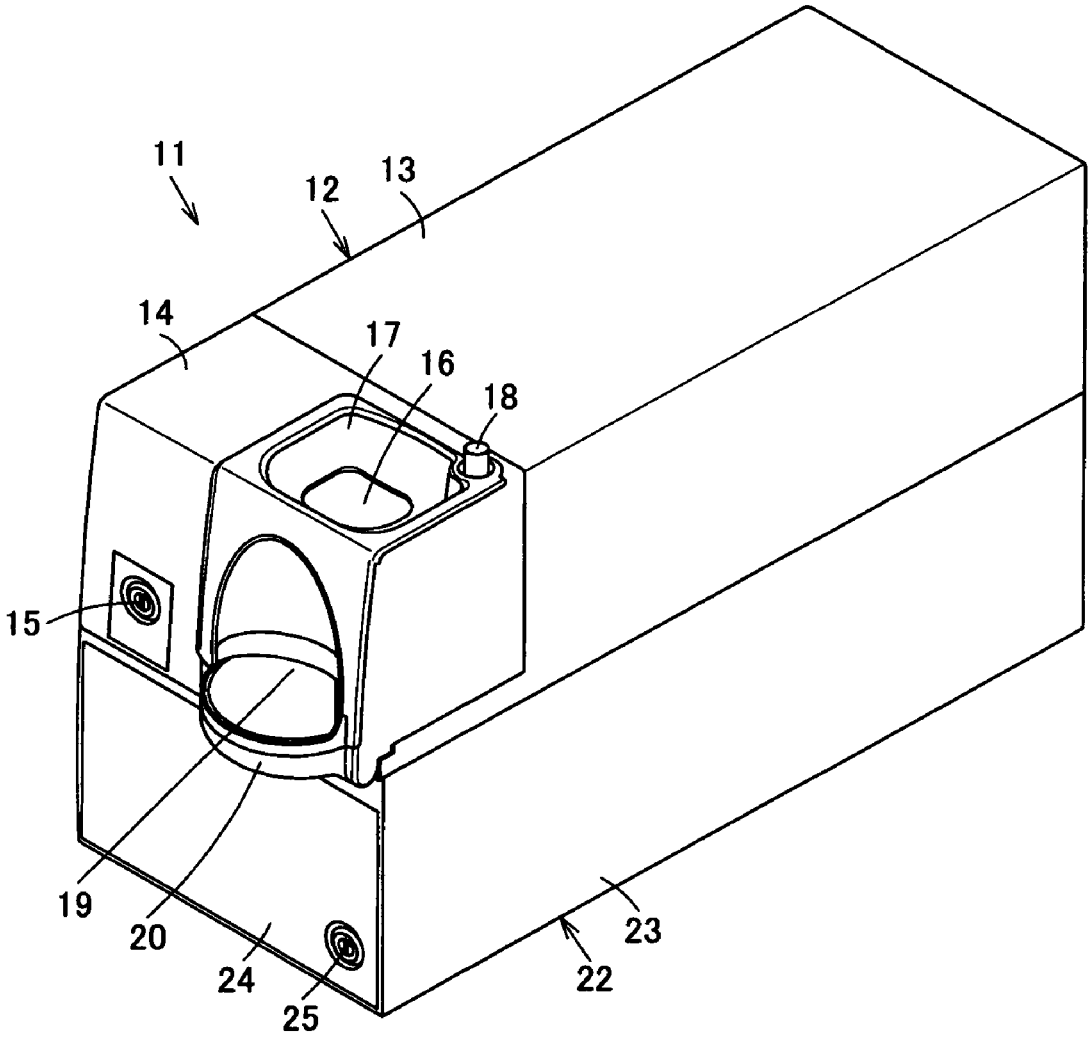
FIG. 9 is a perspective view of the same coin handling machine.

FIG. 9 is a perspective view of a coin handling machine 11 capable of performing a coin dispensing process as well as a coin depositing process by using a coin transporting device as an embodiment of the present invention. This coin handling machine 11 is electrically connected to, for example, a POS register as external apparatus, and can be used as an automatic change dispenser capable of automatically depositing and dispensing coins based on a command from the POS register.

A machine body 12 of the coin handling machine 11 includes a frame body 13 having a front face opened, and a main body unit 14 capable of being drawn out from the front face of the frame body 13. On the front face of the main body unit 14, a lock portion 15 which locks and unlocks the main body unit 14 housed in the frame body 13 by a key is provided.

On the upper face right side of the main body unit 14 projecting from the front portion of the frame body 13, a recessed coin receiving port 17 at which an inlet 16 into which coins are input from the outside of the machine body 12 is formed is disposed. At a position near the inlet 16, a deposit start button 18 for commanding a deposit operation is disposed so as to be depressed.

On the front face right side of the main body unit 14, a dispensing outlet 19 from which coins are ejected from the inside of the machine body 12 is formed, and a tray 20 as a coin takeout unit and a coin dispensing unit which receives coins ejected from the dispensing outlet 19 and allows the received coins from being taken out from the outside is formed.

The lower portion of the coin handling machine 11 is combined with a coin cassette unit 22 on an as needed basis. This coin cassette unit 22 includes a frame body 23 having a front face opened, and a coin cassette 24 capable of being drawn out from the front face of the frame body 23. On the front face of the coin cassette 24, a lock portion 25 which locks and unlocks the coin cassette 24 housed in the frame body 23 by a key is provided. In this coin cassette 24, overflowing coins and collected coins discharged from the main body unit 14 of the coin handling machine 11 are stored.

Figure 2:
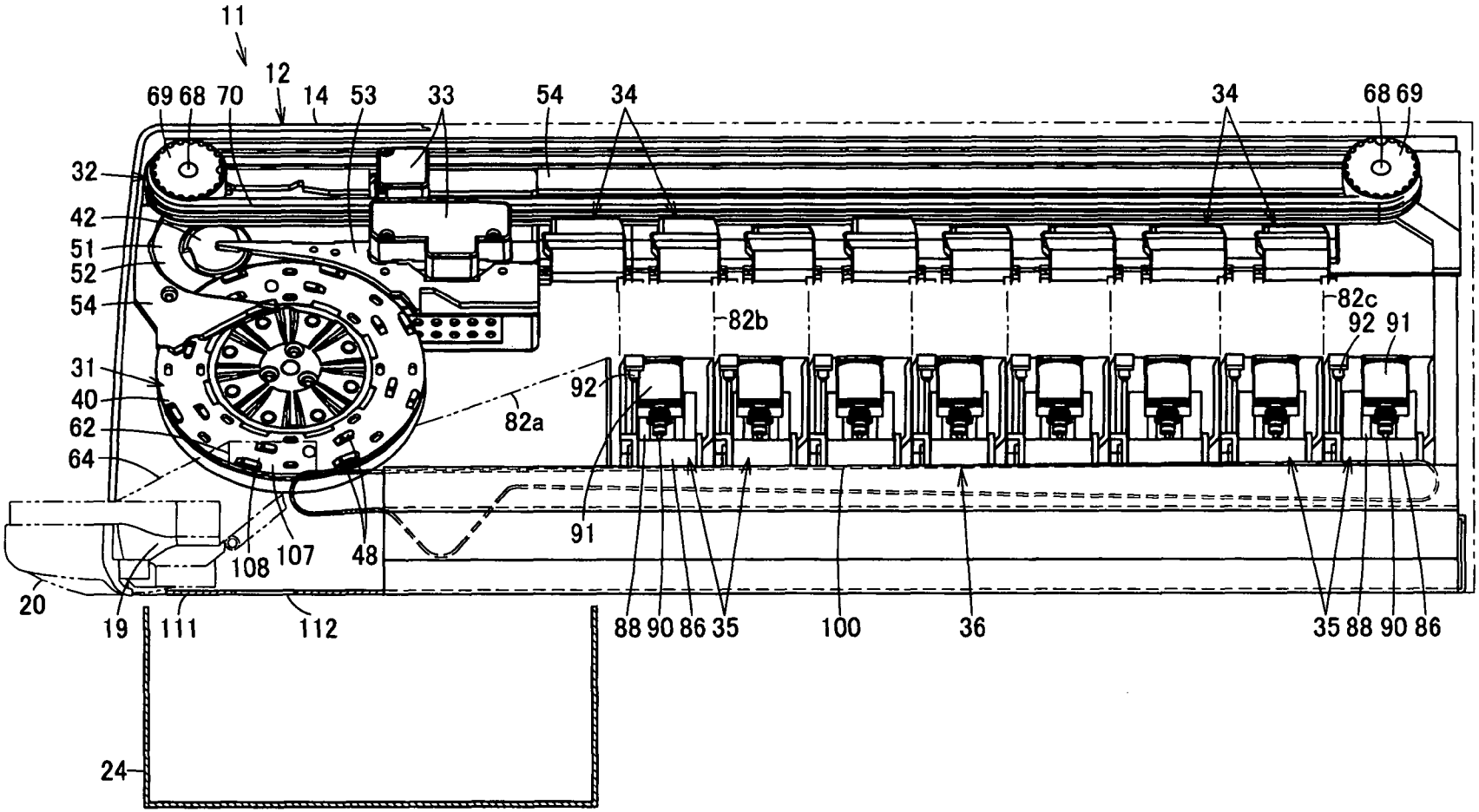
FIG. 2 is a side view showing an internal structure of the same coin handling machine.
Figure 3:
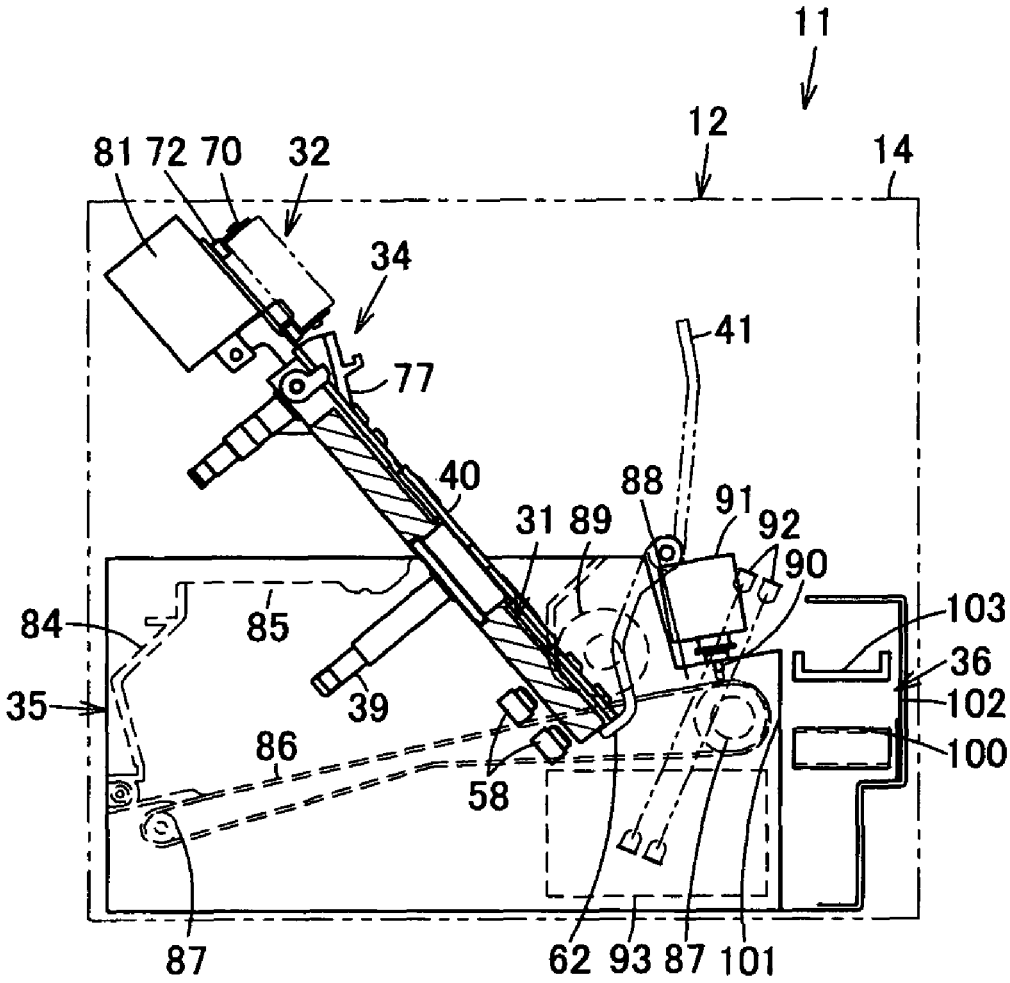
FIG. 3 is a front view showing the internal structure of the same coin handling machine.

Next, in FIG. 1 to FIG. 3, the main body unit 14 includes, a feeding portion 31 as a feeding unit which separates coins (shown by the reference symbol C in the drawings) received from the inlet 16 one by one, a deposit transport unit 32 which transports coins fed from the feeding portion 31 rearward from the front side along the left side face as one side face of the machine body 12, a recognition unit 33 which recognizes coins transported by the deposit transport unit 32, a plurality of diverting units 34 which divert coins transported by the deposit transport unit 32 according to recognition results obtained by the recognition unit 33, denomination-specific coin storing units 35 which are successively disposed from the front face side to the rear face side of the machine body 12 and store coins diverted by the denomination-specific diverting units 34 by denomination, and allow the coins to be ejected one by one toward the right side face as the other side face of the machine body 12, and a dispensing transport unit 36 which is disposed along the right side face of the machine body 12 and transports coins ejected from the coin storing units 35 to the dispensing outlet 19.

As shown in FIG. 1 to FIG. 6, the feeding portion 31 includes a rotary disk 40 rotatable around a rotation axis 39 at a position inclined at a predetermined angle with respect to the horizontal direction, a hopper 41 which pools coins input from the inlet 16 between the hopper 41 and the surface side of the rotary disk 40 with the coins not aligned, and a small-diameter disk 42 disposed at a position for feeding coins from the upper portion side of the rotary disk 40 to the deposit transport unit 32. The feeding portion 31 is positioned higher than the tray 20 of the dispensing outlet 19.

The rotary disk 40 is disposed so as to incline rightward at a predetermined angle with respect to the horizontal direction by the rotation axis 39 attached rotatably to the machine body 12 as viewed from the front face of the machine body 12. This rotary disk 40 is driven to rotate by a motor 44 in a feed rotating direction (counterclockwise in FIG. 1, FIG. 2, and FIG. 4) for feeding coins to the deposit transport unit 32, and when coins jam, the rotary disk 40 is driven to rotate in a direction opposite to the feed rotating direction to eliminate coin jam.

On the surface of the rotary disk 40, a circular higher portion 45 is formed in the central region, and in the outer peripheral region of this higher portion 45, an annular lower portion 46 is formed. On the lower portion 46 of the rotary disk 40, a plurality of picking-up members 48 projecting from the surface of the rotary disk 40 are disposed at predetermined pitches along two circumferential directions of the inner peripheral side circumferential direction and the outer peripheral side circumferential direction. When the rotary disk 40 rotates in the feed rotating direction, coins are picked up to the upper region on the rotary disk 40 one by one by the picking-up members 48 at predetermined intervals, and the picked-up coins are pushed out from the upper portion on the rotary disk 40 and delivered to the small-diameter disk 42. The picking-up members 48 are formed so as to catch and pick up the coins when the rotary disk 40 rotates in the feeding direction, and not to catch coins when the rotary disk 40 rotates in a direction opposite to the feeding direction.

On the upper region on the rotary disk 40, a guide path 51 constituting a coin gateway 50 which feeds coins picked up to the upper region on the rotary disk 40 by the picking-up members 48 one by one to the deposit transport unit 32 and can receive coins returned from the deposit transport unit 32, is formed. This guide path 51 is curved in a generally U shape from the upper portion of the rotary disk 40 and connected to the front end portion of the deposit transport unit 32, and is formed by a path surface 52 which transports coins while being in contact with one surface of the coins, and guide portions 53 and 54 which guide both sides of the coins being transported on the path surface 52. The path surface 52 is flush with the surface of the rotary disk 40, that is, inclines at a predetermined angle with respect to the horizontal direction.

One guide portion 53 is disposed from the upper region above the rotary disk 40 to a region opposed to the central portion of the small-diameter disk 42. The other guide portion 54 is provided so as to curve from a region opposed to the surface of the lower portion 46 of the rotary disk 40 via a clearance into which coins do not enter to the front end portion of the deposit transport unit 32. On the surface opposed to the lower portion 46 of the guide portion 54, a groove portion 55 allowing the picking-up members 48 which rotatably move to pass through is formed. The guide portion 54 receives the coins picked up by the picking-up member 48 and guides the coins to the deposit transport unit 32.

On the lower portion 46 of the rotary disk 40, a plurality of detection holes 57 are formed at predetermined pitches along the circumferential direction. At a position opposed to the lower portion side of the rotary disk 40, a remaining detection sensor 58 as a remaining detection unit which detects the presence of coins and coins and foreign material remaining without being fed through the detection holes 57 of the rotary disk 40 rotating is disposed.

The hopper 41 is opposed to and covers the surface side of the rotary disk 40 and is formed into a shape opened upward so as to receive coins from the inlet 16. On the lower portion of the hopper 41, a discharge mechanism 60 which discharges coins, etc., inside the feeding portion 31 is provided. In this discharge mechanism 60, a discharge port 61 is formed on the lower portion of the hopper 41, and to this discharge port 61, the discharge gate 62 is attached so as to open and close around an axis 62*a* on the upper portion side. The discharge gate 62 is driven to open and close by a discharge gate drive motor 63 as a discharge gate driving unit via the axis 62*a*. By opening the discharge gate 62 and rotating the rotary disk alternately forward and reversely, coins, etc., are discharged downward from the hopper 41. Below the discharge port 61 and the discharge gate 62 of the hopper 41, a chute 64 which guides discharged coins to the tray 20 of the dispensing outlet 19 is disposed.

The small-diameter disk 42 is disposed rotatably at a position across the guide path 51 and a start end portion of the deposit transport unit 32 so that the surface of the small-diameter disk 42 becomes flush with the path surface 52. On the outer peripheral edge portion of the small-diameter disk 42, a pair of projections 65 which come into contact with coins and feed the coins while pushing the coins from the rotary disk 40 to the deposit transport unit 32 is provided so as to project.

Figure 4:
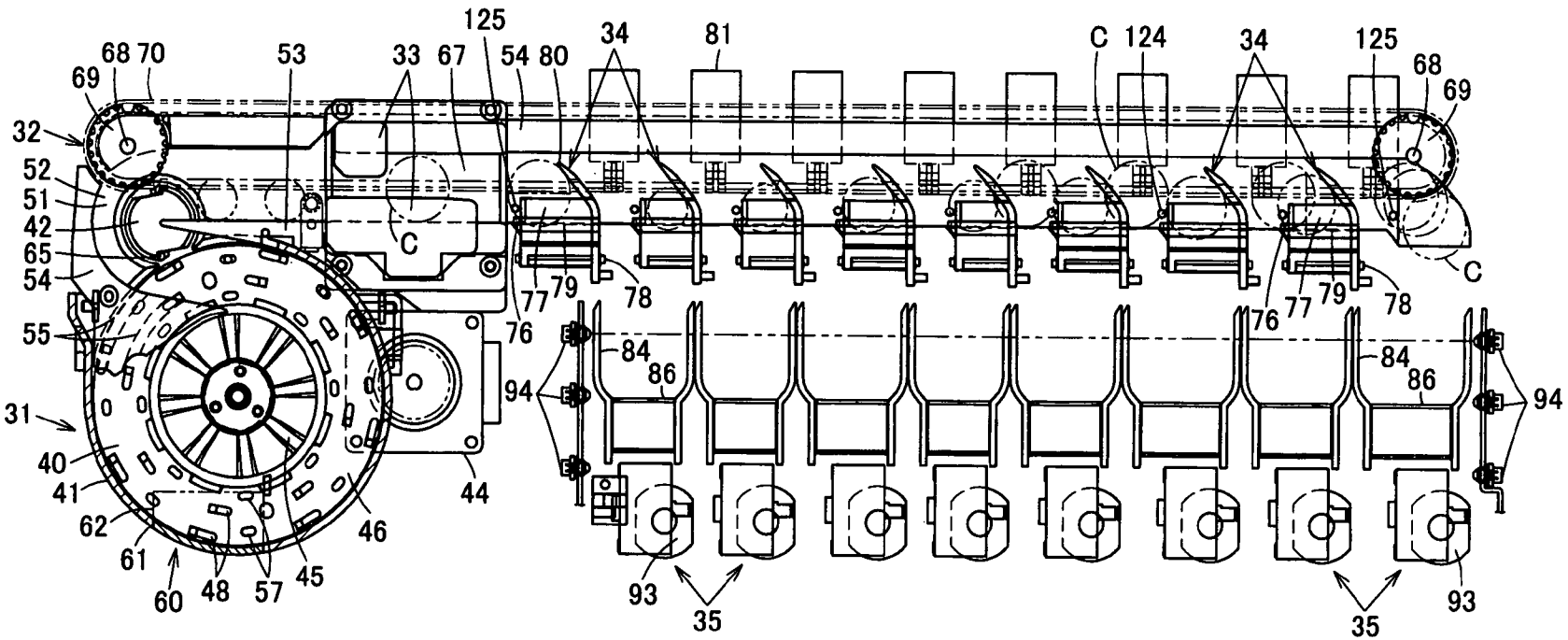
FIG. 4 is a side view of the same coin handling machine from a direction perpendicular to the rotary disk of a receiving/feeding unit.
Figure 5:
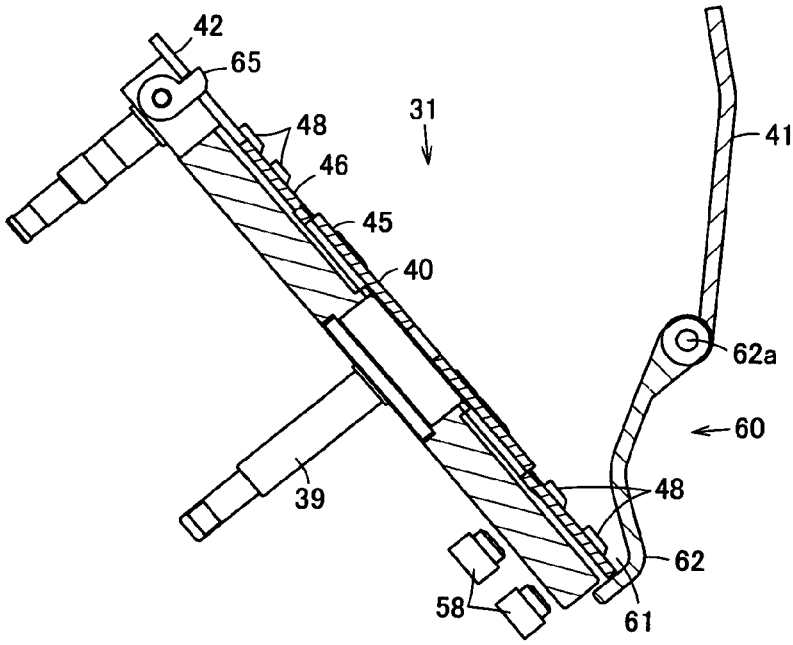
FIG. 5 is a sectional view of a state where a discharge mechanism of the receiving/feeding unit of the same coin handling machine is closed.

Next, as shown in FIG. 4, the deposit transport unit 32 includes a transport path 67 formed continuously to the guide path 51 so as to extend rearward from the front side along the left side upper portion inside the machine body 12. This transport path 67 is formed by the path surface 52 which continues to the guide path 51 and transports coins while being in contact with one surface of the coins, and guide portions 53 and 54 which guide both sides of the coins being transported on the path surface 52. The path surface 52 of the transport path 67 is flush with the surface of the rotary disk 40, so that the path surface 52 is inclined at a predetermined angle with respect to the horizontal direction similar to the inclination of the rotary disk 40. Therefore, a coin to be transported in this transport path 67 is transported while the peripheral edge of the coin is placed on one guide portion 53 at the lower position.

At the start end portion and the terminal end portion of the transport path 67, pulleys 69 are disposed by rotation axes 68 attached rotatably to the machine body 12. By these pulleys 69, a deposit transporting belt 70 as a transporting body is suspended along the transport path 67. The deposit transporting belt 70 is rotated in a transporting direction for transporting coins from the start end side to the terminal end side of the transport path 67 by a deposit transporting belt drive motor 71 (refer to FIG. 10) as a transporting body driving unit which drives the pulleys 69, and is rotatable in a direction opposite to the transporting direction when detecting coin jam.

On the surface of the deposit transporting belt 70 which is opposed to the path surface 52, projections 72 (refer to FIG. 3) which push and transport coins one by one are provided so as to project at predetermined pitches along the belt longitudinal direction. The pitches in the belt longitudinal direction between the plurality of projections 72 are set so as to allow coins to be received one by one between the front and rear projections 72 adjacent in the belt longitudinal direction and transported. Between the deposit transporting belt 70 and the path surface 52, a clearance which allows a coin with a maximum thickness capable of being handled by the coin handling machine 11 to be accepted is formed, and between the projections 72 and the path surface 52, a clearance smaller than the thickness of a coin with a minimum thickness capable of being handled by the coin handling machine 11 is formed.

Rotation of the deposit transporting belt 70 and feeding of the coins by the rotary disk 40 and the small-diameter disk 42 of the feeding portion 31 are interlocked with each other, and coins fed from the feeding portion 31 are received one by one between adjacent projections 72 of the deposit transporting belt 70.

Also, in the transport path 67, the recognition unit 33 and the plurality of diverting units 34 are disposed in order.

Next, the recognition unit 33 detects the material and diameters of the coins and recognizes whether the coins are acceptable into the machine body 12 and the denominations of the acceptable coins.

Next, a diverting unit 34 positioned at a diverting position on the most upstream side in the transporting direction of the transport path 67 is a rejecting diverting unit 34 which diverts coins unacceptable into the machine body 12, and the diverting units 34 on the more downstream side in the transporting direction are denomination-specific diverting units 34 which divert coins acceptable into the machine body 12 by denomination, and are formed into the same structure. At a diverting position on the most downstream side in the transporting direction, no mechanism of the diverting unit is disposed, however, this diverting position is for diverting from the terminal end portion of the transport path 67 by not diverting by any diverting unit 34.

Figure 7:
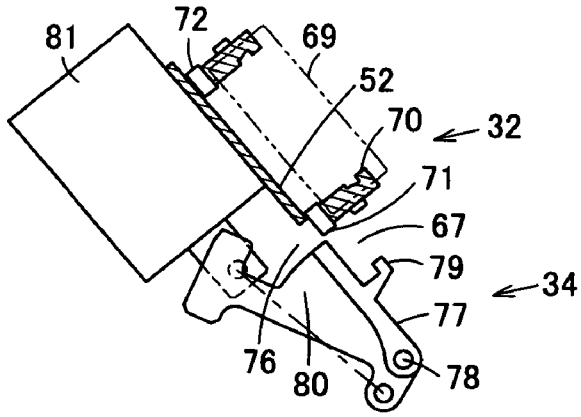
FIG. 7 is a sectional view of a state where coins are made to pass through a diverting unit of the same coin handling machine.
Figure 8:
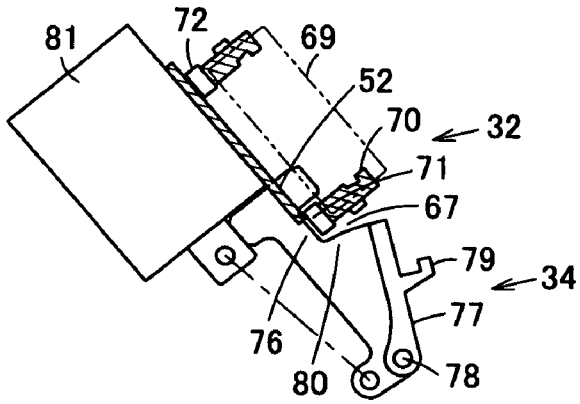
FIG. 8 is a sectional view of a state where coins are diverted by the diverting unit of the same coin handling machine.

As shown in FIG. 4, FIG. 7, and FIG. 8, each diverting unit 34 includes a diverting member 77 which opens and closes an opening 76 formed from the path surface 52 to the lower guide portion 53. This diverting member 77 is supported so that the lower portion thereof is fixed to an axis 78 so as to be swingable around the axis 78 parallel to the transporting direction between a coin passing position at which the diverting member 77 fits into the opening 76 and closes the opening 76 and a coin diverting position at which the diverting member 77 projects toward the surface of the path surface 52 from the inside of the opening 76 and opens the opening 76.

When this diverting member 77 is at the coin passing position at which the diverting member fits in and closes the opening 76 shown in FIG. 7, the surface of the diverting member 77 becomes flush with the path surface 52, and a support portion 79 functioning as a part of the guide portion 53 supporting the peripheral edge portion of a coin is formed on the surface of the diverting member 77. A guide portion 80 is provided so as to project from the edge portion of the diverting member 77 corresponding to the downstream side in the transporting direction toward the reverse surface side. In the state where the diverting member 77 shown in FIG. 8 swings to the coin diverting position, this guide portion 80 projects into the transport path 67 and forcibly drops coins transported by the deposit transporting belt 70 on the transport path 67 inside the opening 76 for divergence.

A solenoid 81 disposed on the reverse surface side of the path surface 52 is joined to the guide portion 80, and the diverting member 77 is switched between the coin passing position and the coin diverting position by driving of the solenoid 81.

At the position of the rejected coin diverting unit 34 on the most upstream side in the transporting direction, a chute 82*a* which guides a coin diverted by the diverting unit 34 to the tray 20 of the dispensing outlet 19 is disposed.

At the positions of the denomination-specific diverting units 34, denomination-specific chutes 82*b* which guide coins diverted by the denomination-specific diverting units 34 to the denomination-specific coin storing units 35 are disposed. At the position of the diverting unit 34 on the most downstream side in the transporting direction, a chute 82*c* which guides a coin ejected from the terminal end of the transport path 67 to the coin storing unit 35 positioned at the rearmost portion of the machine body 12 is disposed.

Next, as shown in FIG. 1, the denomination-specific coin storing units 35 are juxtaposed in order from the front face side to the rear face side of the machine body 12. As shown in FIG. 3, each coin storing unit 35 includes a storing frame 84 which stores coins not aligned. On the upper portion of the storing frame 84, a receiving port 85 which receives coins diverted by the diverting unit 34 from the transport path 67 is formed. On the bottom portion of the storing frame 84, a belt 86 which supports coins stored with the coins not aligned is disposed. This belt 86 is suspended along the left-right direction of the machine body 12 by rollers 87 which are axially supported horizontally to the machine body 12 and rotatable, and suspended so as to incline and rise from the upstream side toward the downstream side in the coin transporting direction, that is, from the deposit transport unit 32 on the left side to the dispensing transport unit 36 on the right side.

On the downstream side in the transporting direction of the belt 86, an eject port 88 for ejecting stored coins to the dispensing transport unit 36 is formed.

In the region above the eject port 88 of the belt 86, reverse roller 89 which aligns the unaligned coins on the belt 86 in a single-layered state in a line by rotating opposite to the transporting direction of the belt 86 to make the coins eject from the eject port 88 is disposed.

On the downstream side in the transporting direction of the position of the reverse roller 89 in the region above the eject port 88 of the belt 86, a stopper 90 which restricts one by one the ejection of the coins to be ejected from the eject port 88 is disposed. This stopper 90 is enabled to advance to and retreat from the eject port 88 from above by the solenoid 91 attached to the machine body 12, and restricts ejection of the coins when advancing and allows the coins to be ejected when retreating.

At the eject port 88, a detection unit 92 for detecting the numbers of coins ejected from the eject port 88 by detecting coins passing through the eject port 88 is disposed.

Below the belt 86, a motor 93 which drives and rotates the belt 86 and the reverse roller 89 is disposed.

As shown in FIG. 4, a plurality of coin detection sensors 94 which project detection light penetrating through the plurality of coin storing units 35 and detect the coins in the coin storing units 35 are disposed. Among the plurality of coin detection sensors 94, one coin detection sensor 94 is disposed near the receiving port 85 and configured as a part of a full detection portion which detects full coins stored in the coin storing units 35.

Next, as shown in FIG. 1 to FIG. 3, the dispensing transport unit 36 includes an endless dispensing transporting belt 100 disposed along the front-rear direction of the machine body 12 on the side portion on the eject port 88 of the plurality of coin storing units 35. This dispensing transporting belt 100 rotates so that the upper surface of the dispensing transporting belt 100 is moved toward the dispensing outlet 19 on the front side according to driving of a motor not shown. The dispensing transporting belt 100 is surrounded by path walls 101 and 102 of both side faces and a path wall 103 of the upper face.

As shown in FIG. 1 and FIG. 2, between the downstream side in the transporting direction of the dispensing transporting belt 100 of the dispensing transport unit 36 and the dispensing outlet 19, a discharge port 107 which allows the coins transported by the dispensing transporting belt 100 to drop and be discharged to the outside of the machine body 12 is formed. At this discharge port 107, a switching member 108 which switches the transport destination of the coins transported by the dispensing transporting belt 100 to the dispensing outlet 19 and the discharge port 107 is disposed. In the bottom plate 111 of the main body unit 14 positioned below the discharge port 107, an opening 112 which allows coins discharged from the discharge port 107 to be stored in the coin cassette 24 is formed. When the coin storing unit 35 becomes full with coins or when collecting coins from the coin storing unit 35, the coins are ejected one by one from the coin storing unit 35, and the coins ejected from the coin storing unit 35 are transported to the discharge port 107 by the dispensing transport unit 36 and collected into the coin cassette 24.

Figure 10:
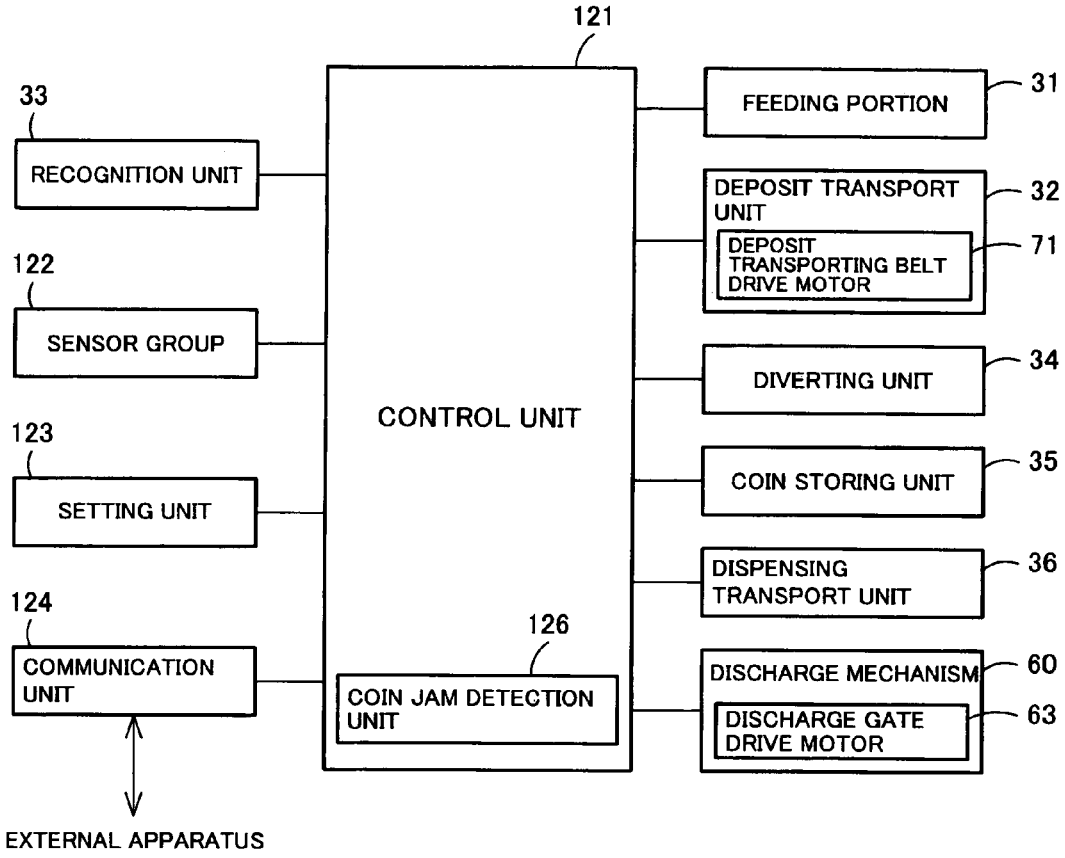
FIG. 10 is a block diagram of the same coin handling machine.

Next, FIG. 10 is a block diagram of the coin handling machine 11, and the reference numeral 121 denotes a control unit which controls the whole coin handling machine 11. To this control unit 121, a recognition unit 33, a sensor group 122 including various sensors for detecting coins at the respective positions inside the coin handling machine 11, and a setting unit 123 which performs various settings, and a communication unit 124 so as to communicate with a POS register are connected.

The sensor group 122 includes, for example, a remaining detection sensor 58 of the feeding portion 31, a plurality of coin position detection sensors 125 (refer to FIG. 4) which are provided along the transport path 67 and detect positions of coins being transported on the transport path 67, and detection portions 92 and coin detection sensors 94 of the coin storing units 35.

The setting unit 123 can set and select whether restore will be performed upon waiting for a restore command from the POS register or restore will be performed without waiting for a restore command from the POS register after detecting coin jam during transportation of coins fed from the feeding portion 31 by the transport path 67.

The control unit 121 controls the feeding portion 31, the deposit transport unit 32, the diverting units 34, the coin storing units 35, the dispensing transport unit 36, and the discharge mechanism 60, etc.

The control unit 121 controls the coin handling machine 11 based on commands from the POS register, and has various functions for controlling the coin handling machine 11, and a part of the functions is as follows.

A function of a coin jam detection unit 126 detects coin jam during transportation of coins fed from the feeding portion 31 by the transport path 67 based on detection by the recognition unit 33 and the plurality of coin position detection sensors 125 and the driving situation, etc., of the deposit transporting belt drive motor 71.

A function to pool coins in the feeding portion 31 by making the discharge gate 62 close in advance by driving the discharge gate drive motor 63, transport the coins on the transport path 67 by the deposit transporting belt 70 by driving the feeding portion 31 and the deposit transporting belt drive motor 71, and when coin jam is detected by the coin jam detection unit 126 during coin transportation, stop driving of the feeding portion 31 and open the discharge gate 62 by driving the discharge gate drive motor 63, rotate the rotary disk 40 and the small-diameter disk 42 in a direction opposite to the feeding direction, return the coins jamming in the transport path 67 to the feeding portion 31 by the deposit transporting belt 70 by driving the deposit transporting belt drive motor 71 in a direction opposite to the transporting direction, and discharge the coins to the tray 20 of the dispensing outlet 19 via the discharge gate 62 being opened.

A function to return coins jamming in the transport path 67 to the feeding portion 31 and discharge the coins to the tray 20 of the dispensing outlet 19 upon waiting for a restore command from the POS register via the communication unit 124 after coin jam is detected during coin transportation in the case where restore upon waiting for a restore command from the POS register is set by the setting unit 123, and on the other hand, in the case where restore without waiting for a restore command from the POS register is set by the setting unit 123, to return coins jamming in the transport path 67 to the feeding portion 31 and discharge the coins to the tray 20 of the dispensing outlet 19 without waiting for a restore command from the POS register via the communication unit 124 after coin jam is detected during coin transportation.

A function to drive the deposit transporting belt drive motor 71 in a direction opposite to the transporting direction at a speed slower than driving in the transporting direction when returning coins jamming in the transport path 67 to the feeding portion 31 and discharging the coins to the tray 20 of the dispensing outlet 19.

Next, operations of the coin handling machine 11 of the present embodiment will be described.

The coin handling machine al is connected to a POS register and operates in response to a command of the POS register. This POS register is operated by a cashier or operated by a customer, and operates equally in these cases.

First, a deposit operation will be described.

An operator who is a cashier or a customer checks out a purchased product, etc., by the POS register, and a customer pays the amount in cash. The amount of cash is input into the coin handling machine 11 from the POS register.

The operator who is a cashier or customer inputs coins to be paid for the amount into the inlet 16 and depresses the deposit start button 18.

When the deposit start button 18 is depressed, a deposit operation is started by driving the feeding portion 31 and the deposit transport unit 32.

Coins input into the inlet 16 drop into the hopper 41 and are guided so as to fall down to the surface of the rotary disk 40. In the feeding portion 31, in response to start of the deposit operation, the rotary disk 40 and the small-diameter disk 42 rotate, and the coins are picked up one by one by the picking-up members 48 projecting from the surface of the rotary disk 40, and fed into the guide path 51 from the upper portion of the rotary disk 40 and delivered one by one to the small-diameter disk 42. The coins received by the projections 65 of the small-diameter disk 42 are fed one by one into the transport path 67 of the deposit transport unit 32. Accordingly, dust and foreign material, etc., input into the inlet 16 together with the coins can be prevented from being fed to the transport path 67, and transportation failures can be prevented from being caused by dust and foreign material, etc.

In the deposit transport unit 32, in response to start of the deposit operation, the deposit transporting belt 70 rotates, coins fed-in one by one by the projections 65 of the small-diameter disk 42 of the feeding portion 31 are received between the projections 72 adjacent to each other of the deposit transporting belt 70, and transported on the transport path 67 toward the downstream side in the transporting direction while being pushed by the projections 72.

Thus, by pushing and transporting one by one the coins on the transport path 67 by the projections 72 of the deposit transporting belt 70, transportation failures can be prevented from being caused by dust and foreign material, etc., and conventional unstableness of the coin transporting state caused by fluctuations in the friction coefficient between the coins and the transporting belt is eliminated, and the coin transporting state can be stabilized.

Coins to be transported on the transport path 67 are recognized by the recognition unit 33.

As a result of recognition by the recognition unit 33, when coins are rejected coins such as coins which are not normal and unacceptable into the machine body 12, unrecognizable coins, and coins disallowed in advance from being deposited, the coins are diverted from the transport path 67 by the rejected coin diverting unit 34 positioned on the most upstream side in the transporting direction.

Specifically, in timing with the time at which a rejected coin reaches the rejected coin diverting unit 34, as shown in FIG. 8, the solenoid 81 is driven and the diverting member 77 is made to project toward the surface side of the path surface 52 from the inside of the opening 76 and swing to a coin diverting position to open the opening 76, and the coin transported on the transport path 67 by the deposit transporting belt 70 is forcibly dropped and diverted into the opening 76 by the guide portion 80 of the diverting member 77. The coin diverted by the rejected coin diverting unit 34 is returned to the tray 20 of the dispensing outlet 19 via the chute 82*a* and is allowed to be taken out by an operator.

As a result of recognition by the recognition unit 33, when a coin is normal and acceptable into the machine body 12, the coin is transported to the position of the diverting unit 34 of the corresponding denomination set in advance and diverted from the transport path 67 by denomination. At this time, in each diverting unit 34 positioned on the upstream side of the diverting unit 34 of the corresponding denomination, the diverting member 77 is at the coin passing position at which the diverting member 77 fits into and closes the opening 76, so that the diverting member 77 allows the coin to pass through the positions of the diverting units 34 positioned on the upstream side and be diverted by the diverting unit 34 of the corresponding denomination. This diverting operation by the denomination-specific diverting units 34 is the same as the operation by the rejected coin diverting unit 34. Coins diverted by the denomination-specific diverting unit 34 drop into and are stored in the coin storing unit 35 of the corresponding denomination.

Then, when no detection signal is output for a predetermined time from the remaining detection sensor 58 which detects coins, etc., on the rotary disk 40 and no coins are recognized by the recognition unit 33 for the predetermined time, it is judged that coins input into the inlet 16 have been completely handled, and driving of the feeding portion 31 and the deposit transport unit 32 is stopped.

When foreign material is input together with a coin, the foreign material is dropped when it is picked up at the upper portion side of the rotary disk 40 from the lower portion side of the rotary disk 40 by the picking-up member 48 of the rotary disk 40, or even if the foreign material is picked up by the picking-up member 48, the foreign material cannot be delivered to the projections 65 of the small-diameter disk 42 and drops, so that the foreign material remains on the rotary disk 40. The foreign material includes deformed coins having a deformed outer shape.

Figure 6:
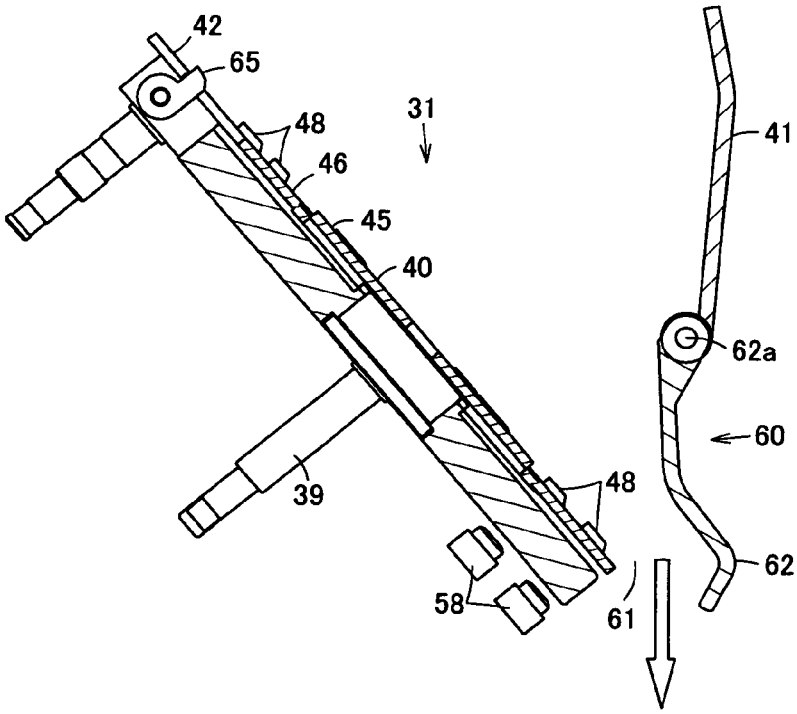
FIG. 6 is a sectional view of a state where a discharge mechanism of the receiving/feeding unit of the same coin handling machine is opened.

In this case, although a detection signal is output from the remaining detection sensor 58 which detects coins, etc., on the rotary disk 40, no coins are recognized by the recognition unit 33 for the predetermined time, so that it is judged that foreign material remains. When foreign material remains, as shown in FIG. 6, by opening the discharge gate 62 of the hopper 41 and opening the discharge port 61 of the hopper 41, the foreign material on the rotary disk 40 is discharged. The foreign material discharged from the feeding portion 31 is returned to the tray 20 of the dispensing outlet 19 via the chute 64 and is allowed to be taken out by an operator.

During coin transportation, when the coin storing unit 35 is detected to be full by detecting that a count value of the number of coins stored in the coin storing unit 35 reached the limit value or by detecting that coins stored in the coin storing unit 35 reached the limit level by the coin detection sensor 94, overflowing coins cannot be stored in the coin storing unit 35, so that unless the coins are collected from the coin storing unit 35, the next deposit transaction cannot be performed, and interruption of deposit transaction due to detection of full is one of the factors which hinders efficient operation. Therefore, during coin transportation, when full coin storing unit 35 is detected, the switching member 108 of the dispensing transport unit 36 is switched to the direction for guiding coins to the discharge port 107, and coins are ejected one by one from the coin storing unit 35 detected as being full, and coins ejected from the coin storing unit 35 are transported to the discharge port 107 by the dispensing transport unit 36 and collected to the coin cassette 24. Accordingly, without interrupting the deposit transaction, handling can be continued.

During coin transportation, when coins jam in the transport path 67 as in the case where coins are caught and jam between the diverting member 77 of a certain diverting unit 34 and the opening 76, based on detections by the recognition unit 33 and the plurality of coin position detection sensors 125 and the driving situation of the deposit transporting belt drive motor 71, occurrence of coin jam is detected by the coin jam detection unit 126. When coin jam is detected, the detection result is transmitted to the POS register via the communication unit 124 and notified by a notification unit of the POS register.

Then, when restore upon waiting for a restore command from the POS register after the coin jam is detected during coin transportation is set in advance by the setting unit 123, an operator who confirmed occurrence of the coin jam performs an operation to command restore by the POS register, and a restore command is issued from the POS register via the communication unit 124, and accordingly, a restoring operation is started. On the other hand, when restore without waiting for a restore command from the POS register is set in advance by the setting unit 123, after coin jam is detected during coin transportation, a restoring operation is started without waiting for a restore command from the POS register via the communication unit 124.

In the restoring operation, after driving of the feeding portion 31 and the deposit transporting unit 32 is stopped, the discharge gate drive motor 63 of the feeding portion 31 is driven to open the discharge gate 62, and the rotary disk 40 and the small-diameter disk 42 are rotated in a direction opposite to the feeding direction, and the deposit transporting belt drive motor 71 of the deposit transport unit 32 is driven in a direction opposite to the transporting direction to rotate the deposit transporting belt 70 in a direction opposite to the transporting direction.

By rotating the rotary disk 40 in a direction opposite to the feeding direction, coins being fed by the picking-up member 48 of the rotary disk 40 can be moved to the lower portion of the rotary disk 40 and discharged. By rotating the small-diameter disk 42 in a direction opposite to the feeding direction, coins being fed and coins returned from the transport path 67 by the projections 65 of the small-diameter disk 42 can be taken into the feeding portion 31.

By rotating the deposit transporting belt 70 in a direction opposite to the transporting direction, coins remaining inside the transport path 67, including coins jamming in the transport path 67, are pushed and transported toward the feeding portion 31 by the projections 72 of the deposit transporting belt 70 and returned to the feeding portion 31. At this time, by driving the deposit transporting belt drive motor 71 in a direction opposite to the transporting direction at a speed slower than driving in the transporting direction, a torque of the deposit transporting belt drive motor 71 is secured, and even when the jamming coins are strongly stuck, the stuck state can be reliably eliminated, and coins to be moved in the direction opposite to the transporting direction can be prevented from being stuck.

Coins in the feeding portion 31 before being fed and coins returned to the feeding portion 31 from the transport path 67 are discharged from the discharge port 61 opened in response to opening of the discharge gate 62, and returned to the tray 20 of the dispensing outlet 19 via the chute 64.

Then, when no more coins are detected by the remaining detection sensor 58, the recognition unit 33, and the plurality of coin position detection sensors 125, the rotations of the rotary disk 40 and the small-diameter disk 42 are stopped, the rotation of the deposit transporting belt 70 of the deposit transport unit 32 are stopped, and the discharge gate drive motor 63 of the feeding portion 31 is driven to open the discharge gate 62.

Then, when an operator takes out the coins returned to the tray 20 of the dispensing outlet 19 and inputs the coins again into the inlet 16, the deposit process can be subsequently restarted.

Thus, even if coins jam during coin transportation, manual restore by an operator is not necessary, and automatic restore is possible and the time until the restore can be shortened, so that a convenient coin handling machine 11 with excellent operability and maintenance performance can be provided.

The location to which the coins jamming in the transport path 67 are discharged is commonly used as the tray 20 of the dispensing outlet 19 to which coins dispensed from the coin storing units 35 are dispensed, so that the convenience for operators is improved.

Next, a dispensing operation will be described.

When dispensing change, coins are ejected one by one from the coin storing unit 35 of the corresponding denomination in response to a signal of a dispensing command from the POS register, and dispensed to the tray 20 of the dispensing outlet 19 through the dispensing transport unit 36.

Specifically, in the coin storing unit 35 of the corresponding denomination, by rotating the belt 86 by driving of the motor 93 and rotating the reverse roller 89 reversely, unaligned coins on the belt 86 are single-layered in a line by the reverse roller 89 and ejected from the eject port 88. At this time, the stopper 90 is withdrawn from the eject port 88 by the solenoid 91, and the ejected coins are detected by the detection portion 92 and the number of ejected coins is counted. When the number of ejected coins of the corresponding denomination reaches the number of coins to be dispensed, the stopper 90 is made to enter the eject port 88 by the solenoid 91 to forcibly stop the ejection of the coins, and driving of the motor 93 is stopped and the ejecting operation is stopped.

The coins ejected from the eject port 88 of the coin storing unit 35 are dispensed to the tray 20 of the dispensing outlet 19 by the dispensing transporting belt 100 of the dispensing transport unit 36.

During coin transportation, when full coin storing unit 35 is detected, overflowing coins may be discharged to the outside from the back face of the machine body 12. This can be applied to, for example, the case of an operation in which the coin cassette unit 22 is not disposed at the lower side of the coin handling machine 11.

Figure 11:
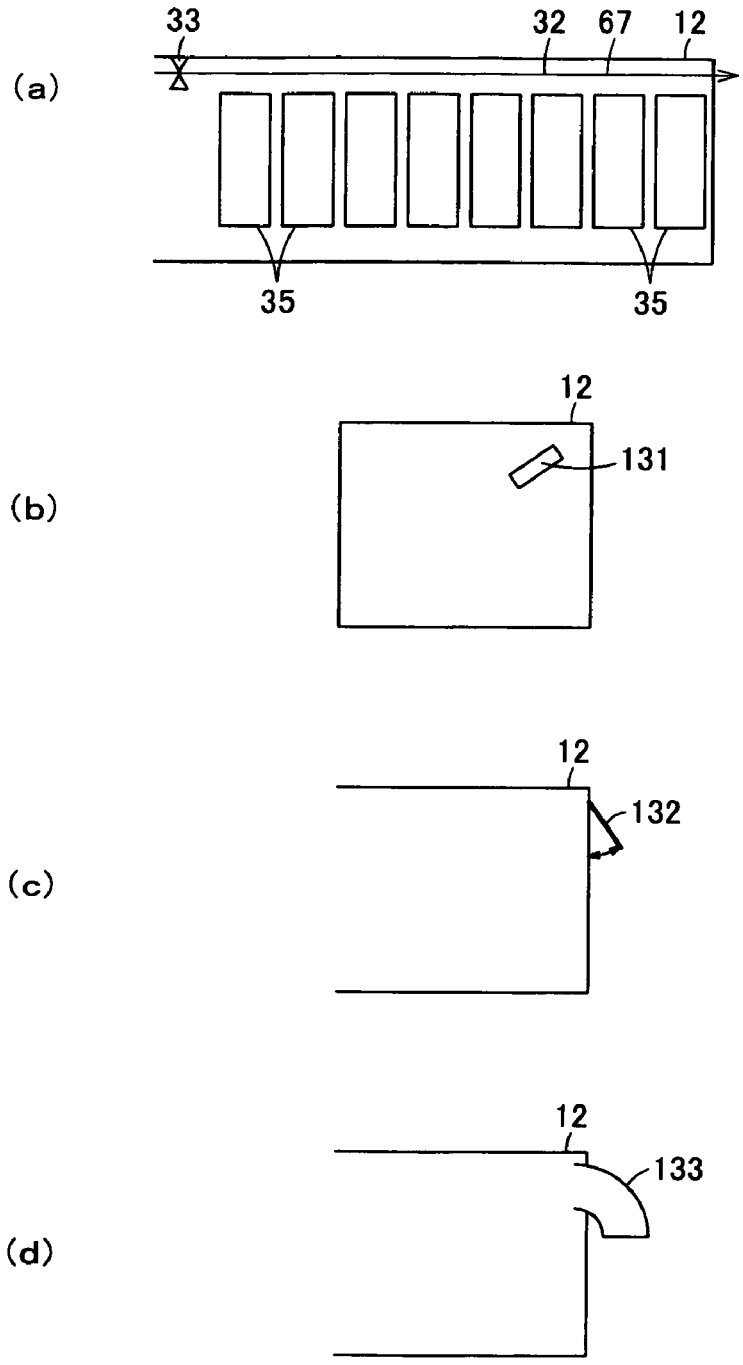
FIG. 11 show a coin handling machine according to a second embodiment of the present invention, and FIG. 11(*a*) is a sectional view of a part of the coin handling machine, FIG. 11(*b*) is a back view when a slit is provided in the back face of the coin handling machine, FIG. 11(*c*) is a side view when a gate is provided on the back face of the coin handling machine, and FIG. 11(*d*) is a side view when a discharge guide is attached to the back face of the coin handling machine.

FIG. 11 show a second embodiment in which overflowing coins are discharged to the outside from the back face of the machine body 12. In the coin handling machine 11, when full coin storing unit 35 is detected during coin transportation, overflowing coins are transported to the rear end of the transport path 67, and discharged to the outside from the slit 131 (refer to FIG. 11(*b*)) provided in the back face of the machine body 12, the gate 132 (refer to FIG. 11(*c*)) provided to open and close on the back face of the machine body 12, or the discharge guide 133 (refer to FIG. 11(*d*)) attached to the back face of the machine body 12. On the back face of the machine body 12, a storing portion for storing overflowing coins to be discharged is disposed.

Figure 12:
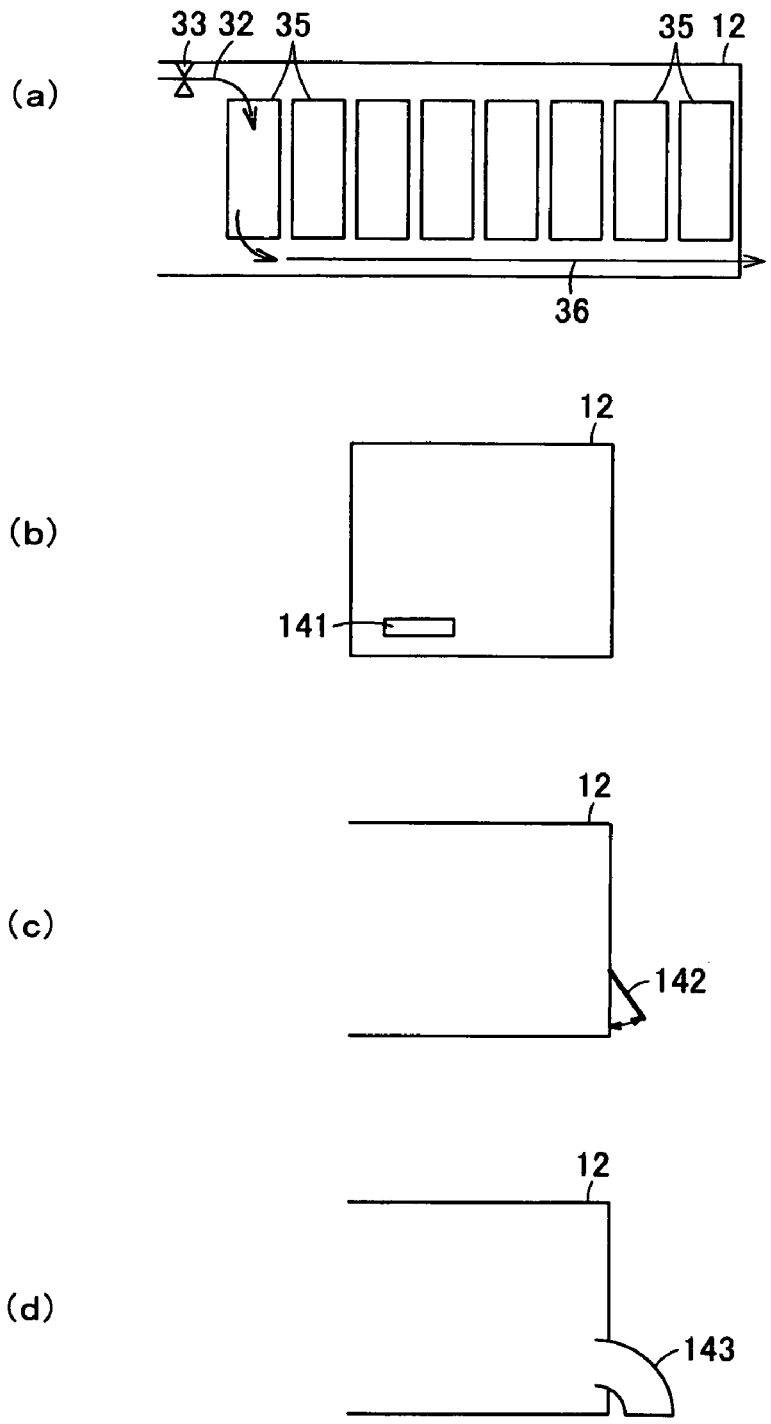
FIG. 12 show a coin handling machine according to a third embodiment of the present invention, and FIG. 12(*a*) is a sectional view of a part of the coin handling machine, FIG. 12(*b*) is a back view when a slit is provided in the back face of the coin handling machine, FIG. 12(*c*) is a side view when a gate is provided on the back face of the coin handling machine, and FIG. 12(*d*) is a side view when a discharge guide is attached to the back face of the coin handling machine.

FIG. 12 show a third embodiment in which overflowing coins are discharged to the outside from the back face of the machine body 12. In the coin handling machine 11, when full coin storing unit 35 is detected during coin transportation, the overflowing coin is stored in the coin storing unit 35 of the corresponding denomination, and a coin stored in this coin storing unit 35 is ejected instead of the overflowing coin to the dispensing transport unit 36, transported to the rear end of the dispensing transport unit 36 by driving the dispensing transport unit 36 in a direction opposite to the transporting direction, and discharged to the outside from the slit 141 (refer to FIG. 12(*b*)) provided in the back face of the machine body 12, the gate 142 (refer to FIG. 12(*c*)) provided so as to open and close on the back face of the machine body 12, or the discharge guide 143 (refer to FIG. 12(*d*)) attached to the back face of the machine body 12. On the back face of the machine body 12, a storing portion for storing overflowing coins to be discharged is disposed.

Thus, it may be arbitrarily set by the setting means 123 as to whether overflowing coins will be discharged to the outside from the back face of the machine body 12. Alternatively, for example, when the discharge guide 133 or 143 is attached to the machine body 12, this attachment is detected and the operation is automatically switched so that the overflowing coins are discharged to the outside from the back face of the machine body 12.

Industrial Applicability

The present invention is applicable to coin handling machines such as money handling machines capable of handling both coins and banknotes as well as coin handling machines such as coin depositing machines and coin depositing and dispensing machines.

The invention claimed is:

1. A coin transporting device which transports coins, comprising:

a feeding unit which pools coins not aligned and feeds the pooled coins one by one;

a transport path which receives coins fed from the feeding unit;

a transporting body including a plurality of projections which receive coins fed into the transport path from the feeding unit and enables the coins to be pushed and transported one by one on the transport path;

a transporting body driving unit which drives the transporting body;

a discharge gate which is provided in the feeding unit and allows coins to be pooled in the feeding unit in a gate closed state, and allows the coins inside the feeding unit to be discharged to the outside in a gate opened state;

a discharge gate driving unit which drives the discharge gate;

a coin takeout unit formed so as to receive coins discharged from the discharge gate and allow the received coins to be taken out from the outside of the device; and a control unit which feeds coins into the transport path by driving the feeding unit when transporting the coins, transports coins on the transport path by the transporting body by driving the transporting body driving unit, and when coins jam in the transport path during coin transportation, stops driving of the feeding unit, opens the discharge gate by driving the discharge gate driving unit, returns the coins jamming in the transport path to the feeding unit by the transporting body by driving the transporting body driving unit in a direction opposite to a transporting direction, and discharges the coins to the coin takeout unit via the discharge gate.

2. The coin transporting device according to claim 1, wherein the feeding unit includes:

a coin gateway which coins can enter and exit from;

a rotary disk which is attached to a rotation axis and is rotated at a position inclined at a predetermined angle with respect to the horizontal direction;

a hopper which pools coins on the surface side of the rotary disk;

a picking-up member which projects from the surface of the rotary disk and picks the pooled coins up one by one; and a delivering disk which is disposed near the coin gateway, receives coins picked up one by one at predetermined intervals by the picking-up member, and delivers the coins one by one to the transporting body.

3. The coin transporting device according to claim 2, wherein the discharge gate forms a part of the lower side of the hopper.

4. The coin transporting device according to claim 1, wherein the control unit drives the transporting body driving unit in a direction opposite to the transporting direction at a speed slower than driving in the transporting direction when discharging coins jamming in the transport path to the coin takeout unit.

5. A coin handling machine which handles coins comprising:

a feeding unit which pools coins not aligned and feeds the pooled coins one by one;

a transport path which receives coins fed from the feeding unit;

a transporting body including a plurality of projections which receive coins fed into the transport path from the feeding unit and enables the coins to be pushed and transported one by one inside the transport path;

a transporting body driving unit which drives the transporting body;

a discharge gate which is provided in the feeding unit and allows coins to be pooled in the feeding unit in a gate closed state, and allows the coins inside the feeding unit to be discharged to the outside in a gate opened state;

a discharge gate driving unit which drives the discharge gate;

a coin dispensing unit formed so as to receive coins discharged from the discharge gate and allow the received coins to be taken out from the outside of the coin handling machine; and a control unit which feeds coins into the transport path by driving the feeding unit when transporting the coins, transports coins in the transport path by the transporting body by driving the transporting body driving unit, and when coins jam in the transport path during coin transportation, stops driving of the feeding unit, opens the discharge gate by driving the discharge gate driving unit, returns the coins jamming in the transport path to the feeding unit by the transporting body by driving the transporting body driving unit in a direction opposite to a transporting direction, and discharges the coins to the coin dispensing unit via the discharge gate.

6. The coin handling machine according to claim 5, wherein the feeding unit includes:

a coin gateway which coins can enter and exit from;

a rotary disk which is attached to a rotation axis and is rotated at a position inclined at a predetermined angle with respect to the horizontal direction;

a hopper which pools coins on the surface side of the rotary disk;

a picking-up member which projects from the surface of the rotary disk and picks the pooled coins up one by one; and a delivering disk which is disposed near the coin gateway, receives coins picked up one by one at predetermined intervals by the picking-up member, and delivers the coins one by one to the transporting body.

7. The coin handling machine according to claim 6, wherein the discharge gate forms a part of the lower side of the hopper.

8. The coin handling machine according to claim 5, comprising:

a communication unit capable of communicating with an external apparatus, wherein after coins jam during coin transportation, the control unit opens the discharge gate by driving the discharge gate driving unit according to a restore command issued from the external apparatus via the communication unit, returns the coins jamming in the transport path to the feeding unit by the transporting body by driving the transporting body driving unit in a direction opposite to the transporting direction, and discharges the coins to the coin dispensing unit via the discharge gate.

9. The coin handling machine according to claim 8, comprising:

a coin storing unit which stores coins and allows stored coins to be dispensed to the coin dispensing unit according to a dispensing command issued from the external apparatus via the communication unit, wherein the coin dispensing unit is formed so as to receive the coins dispensed from the coin storing unit and allow the received coins to be taken out from the outside of the coin handling machine.

10. The coin handling machine according to claim 8, comprising:

a setting unit which sets whether restore will be performed upon waiting for a restore command from the external apparatus or restore will be performed without waiting for a restore command from the external apparatus after coins jam during coin transportation, wherein when restore without waiting for a restore command from the external apparatus is set by the setting means, the control unit discharges coins jamming in the transport path to the coin dispensing unit without waiting for a restore command from the external apparatus via the communication unit after the coins jam during coin transportation.

11. The coin handling machine according to claim 5, wherein the control unit drives the transporting body driving unit in a direction opposite to the transporting direction at a speed slower than driving in the transporting direction when discharging coins jamming in the transport path to the coin dispensing unit.

* * * * *